United States Patent [19]

Rimai et al.

[11] Patent Number: 4,927,727

[45] Date of Patent: May 22, 1990

[54] THERMALLY ASSISTED TRANSFER OF SMALL ELECTROSTATOGRAPHIC TONER PARTICLES

[75] Inventors: Donald S. Rimai, Webster; Chandra Sreekumar, Rochester, both of N.Y.

[73] Assignee: Eastman Kodak Company, Rochester, N.Y.

[21] Appl. No.: 230,394

[22] Filed: Aug. 9, 1988

[51] Int. Cl.[5] ..... G03G 13/14; G03G 13/16

[52] U.S. Cl. ..... 430/99; 430/124; 430/126

[58] Field of Search ..... 430/99, 124, 126

[56] References Cited

U.S. PATENT DOCUMENTS

| | | | |
|---|---|---|---|
| 2,855,324 | 10/1958 | VanDorn | 117/25 |
| 3,592,642 | 7/1971 | Kaupp | 96/1.4 |
| 3,965,478 | 6/1976 | Schloemann | 346/74.1 |
| 4,430,412 | 2/1984 | Miwa et al. | 430/126 |
| 4,439,462 | 3/1984 | Tarumi et al. | 430/126 |
| 4,737,433 | 4/1988 | Rimai et al. | 430/111 |

FOREIGN PATENT DOCUMENTS

| | | |
|---|---|---|
| 0104625 | 4/1984 | European Pat. Off. . |
| 55-74570 | 6/1980 | Japan . |

*Primary Examiner*—John L. Goodrow

*Attorney, Agent, or Firm*—Willard G. Montgomery

[57] ABSTRACT

Disclosed is an improved method of making a hard copy in a process where a latent electrostatic image on an image-bearing substrate is developed by applying to the image a dry thermoplastic toner which comprises a binder polymer, and the developed image is transferred to the surface of a receiver by contacting the developed image on the substrate with the surface, then removing the surface from the substrate. The improvement comprises developing the latent electrostatic image with a toner having a particle size less than 8 micrometers, heating the surface before it contacts the developed image to a temperature such that the surface heats the toner particles when it contacts the developed image to a temperature between 10° C. above the $T_g$ of the toner binder and 20° C. below the $T_g$ of the toner binder, where the temperature is sufficient to fuse discrete toner particles that form the image to each other at points of contact between the particles, but insufficient to cause the contacting particles to flow into a single mass, non-electrostatically transferring the developed image to the surface, where the roughness average of the surface is less than the radius of the particles, and heating the developed image after it has been removed from the substrate to a temperature sufficient to fix it.

19 Claims, 2 Drawing Sheets

THERMALLY ASSISTED TRANSFER OF SMALL ELECTROSTATOGRAPHIC TONER PARTICLES

TECHNICAL FIELD

This invention relates to a thermally assisted method of transferring and fixing electrostatographic toner particles that have a particle size of less than 8 micrometers. In particular, it relates to such a process where the receiver surface is heated before the transfer occurs, the transfer is not electrostatically assisted, and the toner is not fixed during transfer.

BACKGROUND ART

In a conventional electrostatographic copying process, a laten electrostatic image is formed on an insulating substrate, such as a photoconductor. If a dry development process is used, charged toner particles are applied to the electrostatic image, where they adhere in proportion to the magnitude of the electrostatic potential difference between the toner particles and the charges on the image. Toner particles that form the developed image are transferred to a receiver by pressing the surface of the receiver against the developed image. It is conventional to use either an electrostatically biased roller or a corona to transfer toner particles from the image bearing substrate to the receiver. The transferred particles are then fixed to the receiver surface by a suitable method such as the application of heat.

While this conventional process works well with large toner particles, difficulties arise as the size of the toner particles is reduced. Smaller toner particles are necessary to achieve higher resolution copies but, as the size of the toner particles falls below about 8 micrometers, the surface forces holding the toner particles to the substrate tend to dominate over the electrostatic force that can be applied to the particles to assist their transfer to the receiver. Thus, less toner transfers and image quality suffers increases in mottle. In addition, as the particle size decreases, certain other image defects also begin to increase, such as the "halo defect," where tone particles that are adjacent to areas of maximum toner density fail to transfer, and "hollow character," where the centers of fine lines fail to transfer. "Dot explosion," where toner particles comprising half tone dots scatter during transfer, also occurs during electrostatic transfer. Some of these defects are believed to be due to repulsive coulombic forces between the particles. This, high resolution images require very small particles, but high resolution images without image defects have not been achievable using electrostatically assisted transfer.

One alternative process of transferring toner particles, without using an electrostatic bias, is to melt or fuse the particles to the receiver during transfer by heating the toner above its melting point. While this process does ameliorate image quality by reducing the defects that are aggravated by electrostatically assisted transfer, it, in turn, creates new problems that must be overcome. First, that process requires higher temperatures than does the conventional process, and these higher temperatures subject the substrate (e.g., a photoconductor) to higher temperatures. This can alter the electrical and photoconductive characteristics of the substrate, and/or cause physical distortions, and therefore mandate the use of more thermally stable materials, which may be more expensive and/or less suitable for other reasons. The receiver is also subjected to higher temperatures over a long period of time which can weaken and deteriorate the receiver and blister its surface. Also, because of the time required for enough heat to transfer from the receiver to the toner to melt it, the process is slow; typical process speeds are of the order of only 0.4 meters/minute. Melted toner may also occasionally fuse to the substrate, which may permanently damage the substrate. A special cleaning process is also needed if the substrate is to be reused, and cleaning adds to the cost of the process and subjects the substrate to additional thermal cycling. High pressures (about 345 to 760 kPa) are also needed in this process. These high pressures, in conjunction with the high temperature and long nip duration time, can be especially hard on a substrate.

SUMMARY OF THE INVENTION

In accordance with this invention, toner particles are transferred non-electrostatically to a receiver that is heated, but the receiver is not heated sufficiently to melt the particles. It has been found that it is not necessary to melt the toner particles in order to achieve their transfer, but that merely fusing toner particles to each other at their points of contact is adequate to accomplish a complete, or nearly complete, transfer of the particles. Thus, the toner is not fixed during transfer but is instead fixed at a separate location, away from the substrate. In this way, the higher temperatures required for fixing the toner do not affect the substrate. Since the heat required to merely sinter the toner particles at their points of contact is much lower than the heat needed to fix the toner, the substrate is not damaged by high temperatures during transfer and conventional substrate materials can be used. Also, because the transfer in the process of this invention is completely non-electrostatic, image defects that are aggravated by an electrostatically assisted transfer are not a problem in the process of this invention. And, also because the transfer is not electrostatically assisted, the electrical conductivity of the toner is much less important, so single component developers and more conductive toners can be used, while otherwise they could not be used with satisfactory results. Moreover, small toner particles (i.e., less than 8 micrometers), which cannot be effectively transferred electrostatically, can be transferred with high efficiency using this process.

It has further been found that if the receiver is heated only at the nip, the temperature of the receiver surface when it contacts the toner particles cannot be controlled. That is, at times insufficient heat penetrates through the receiver to fuse the toner particles at their points of contact and the toner therefore does not transfer well, while at other times so much heat passes through the receiver that the toner melts completely and the photoconductor is damaged. It has been found that this problem can be overcome by preheating the receiver surface before transfer occurs so that the temperature of the receiver surface is always within the range required to fuse the toner particles at their points of contact without melting them.

BRIEF DESCRIPTION OF DRAWINGS

In FIG. 1, a receiver sheet 1 is preheated by heater 2 to a temperature adequate to fuse toner particles at their points of contact during transfer, but inadequate to melt the particles. A photoconductive drum 3 has been uniformly charged by corona 4, then imagewise exposed to light at station 5, which discharged exposed portions of the drum, forming a latent electrostatic image on the drum. This image is developed by the application of toner particles 6 having a particle size of less than 8 micrometers, to the image at station 7. The developed image 9 is transferred to receiver 1 at nip 10, which is formed between drum 3 and backup roller 11. Receiver 1 passes between heated rollers 12 and 13 which fix the toner particles to the receiver.

DETAILED DESCRIPTION OF THE INVENTION

Figure 1:
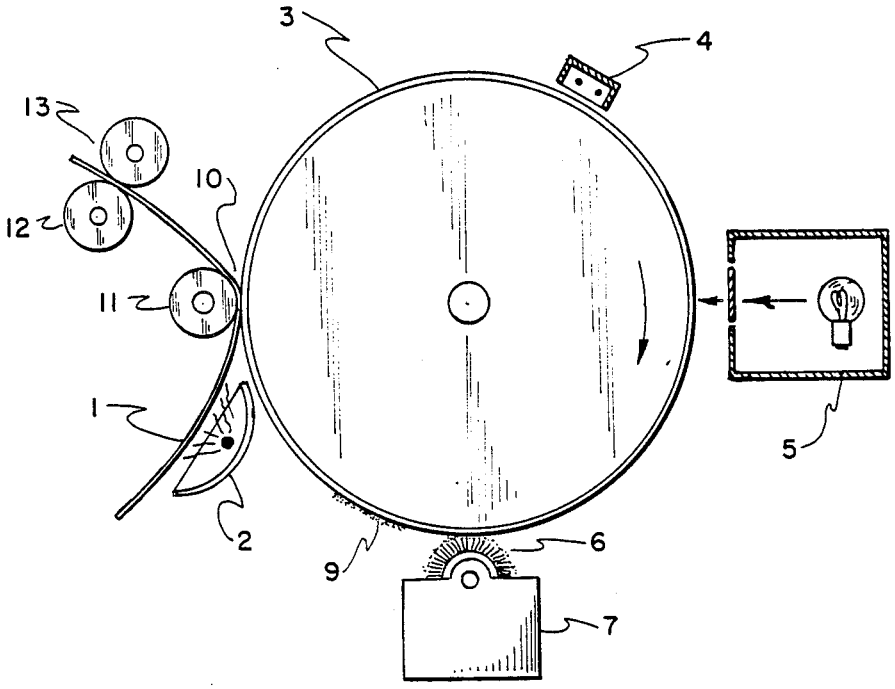
FIG. 1 is a diagrammatic side view illustrating a certain presently preferred embodiment of the process of this invention.

Toners useful in this invention are dry toners having a particle size of less than 8 micrometers, and preferably less than 5 micrometers, as the problems that this invention are directed to are not significant when the particle size of the toner is much greater than 8 micrometers, while the problems are especially intense when the particle size is less than 5 micrometers. (Particle size herein refers to mean volume weighted diameter as measured by conventional diameter measuring devices such as a Coulter Multisizer, sold by Coulter, Inc. Mean volume weighted diameter is the sum of the mass of each particle times the diameter of a spherical particle of equal mass and density, divided by total particle mass.) The toners must contain a thermoplastic binder in order to be fusible. The toner binder should have a glass transition temperature, $T_g$, of about 40° to about 100° C., and preferably about 45° to about 65° C., as a lower $T_g$ may result in a clumping of the toner as it is handled at room temperature, while a higher $T_g$ renders the process of this invention too energy intensive and may heat the substrate too much, resulting in damage to the substrate and various transfer problems. Preferably, the toner particles have a relatively high caking temperature, for example, higher than about 60° C., so that the toner powders can be stored for relatively long periods of time at fairly high temperatures without individual particles agglomerating and clumping together.

The melting point of polymers useful as toner binders preferably is about 65° C. to about 200° C. so that the toner particles can be readily fused to a receiver to form a permanent image. Especially preferred polymers are those having a melting point of about 65° to about 120° C. The polymers useful as toner binders in the practice of the present invention can be used alone or in combination and include those polymers conventionally employed in electrostatic toners. Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers as described in U.S. Pat. No. Re. 31,072.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric ester of acrylic and methacrylic acid such as poly(alkyl acrylate), and poly(alkyl methacrylate) wherein the alkyl moiety can contain from 1 to about 10 carbon atoms. Additionally, other polyesters having the aforementioned physical properties are also useful. Among such other useful polyesters are copolyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which can also be a halogen-substituted alkane), and in the alkylene moiety.

Other useful polymers are various styrene-containing polymers. Such polymers can comprise, e.g., a polymerized blend of from about 40 to about 100 percent by weight of styrene, from 0 to about 45 percent by weight of a lower alkyl acrylate or methacrylate having from 1 to about 4 carbon atoms in the alkyl moiety such as methyl, ethyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. No. 2,917,460; U.S. Pat. Nos. Re 25,316; 2,788,288; 2,638,416; 2,618,552 and 2,659,670. Preferred toner binders are polymers and copolymers of styrene or a derivative of styrene and an acrylate, preferably butylacrylate.

Useful toner particles can simply comprise the polymeric particles but it is often desirable to incorporate addenda in the toner such as waxes, colorants, release agents, charge control agents, and other toner addenda well known in the art. The toner particle can also incorporate carrier material so as to form what is sometimes referred to as a "single component developer." The toners can also contain magnetizable material, but such toners are not preferred because they are available in only a few colors and it is difficult to make such toners in the small particles sizes required in this invention.

If a colorless image is desired, it is not necessary to add colorant to the toner particles. However, more usually a visibly colored image is desired and suitable colorants selected from a wide variety of dyes and pigments such as disclosed for example, in U.S. Pat. No. Re. 31,072 are used. A particularly useful colorant for toners to be used in black-and-white electrophotographic copying machines is carbon black. Colorants in the amount of about 1 to about 30 percent, by weight, based on the weight of the toner can be used. Often about 8 to 16 percent, by weight, of colorant is employed.

Charge control agents suitable for use in toners are disclosed for example in U.S. Pat. Nos. 3,893,935;

4,079,014; 4,323,634 and British Patent Nos. 1,501,065 and 1,420,839. Charge control agents are generally employed in small quantities such as about 0.1 to about 3, weight percent, often 0.2 to 1.5 weight percent, based on the weight of the toner.

Toners used in this invention can be mixed with a carrier vehicle. The carrier vehicles, which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571.

The carrier core particles can comprise conductive, non-conductive, magnetic, or non-magnetic materials. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

The very small toner particles that are required in this invention can be prepared by a variety of processes well-known to those skilled in the art including spray-drying, grinding, and suspension polymerization.

The image-bearing substrate can be in the form of a drum, a belt, a sheet, or other shape, and can be made of any of the conventional materials used for such purposes. While dielectric recording materials can be used, photoconductive materials are preferred, and organic photoconductive materials are preferred over inorganic photoconductive materials, because they produce an image of superior quality. While the image-bearing substrate can be a single use material, reusable substrates are preferred as they are less expensive. Of course, reusable substrates must be thermally stable at the temperature of transfer. The surface properties of the substrate and the receiver should be adjusted so that at the operating temperature of the transfer the toner adhesion to the substrate is less than the toner adhesion to the receiver. This can be accomplished by using substrates having low surface energy, such as polytetrafluoroethylene coated polyesters, or by incorporating low surface adhesion (LSA) materials, such as zinc stearate, into the substrate or coating the substrate with an LSA material.

In order to insure that the toner adhesion to the receiver is greater than the toner adhesion to the substrate at the temperature of transfer, the properties of the receiver surface can also be selected so as to increase the adhesion of the toner particles to that surface. This can most advantageously be accomplished by coating the receiver with a thermoplastic that will not stick to the photoconductor, or by coating the receiver with a thermoplastic polymer over which is coated a release agent which preferably has a lower surface energy than said substrate, as is described in copending application Ser. No. 230,381, titled "Improved Method Of Non-Electrostatically Transferring Toner," filed Aug. 9, 1988, herein incorporated by reference. If a receiver is coated with a thermoplastic polymer, it is important that the $T_g$ of the thermoplastic polymer be less than 10° C. above the $T_g$ of the toner binder and that the receiver be heated to a temperature above the $T_g$ of the thermoplastic polymer, so that the thermoplastic coating softens and the toner particles become embedded therein.

Any conductive or nonconductive material can be used as the receiver, including various metals such as aluminum and copper and metal coated plastic films, as well as organic polymeric films and various types of paper. If a transparent polymeric receiver, such as polyethylene terephthalate, is used, good transparencies can be made using the process of this invention. Paper is the preferred receiver material because it is inexpensive and the high quality image produced by the process of this invention is most desirably viewed on paper. In order to achieve an acceptably high transfer efficiency and good image quality the receiver must have a roughness average that is less than the radius (i.e., one-half the herein defined diameter) of the toner particles, where the roughness average is an indication of surface roughness, the value of which is the average height of the peaks in micrometers above the mean line between peaks and valleys. A suitable device to measure this value directly is a profilometer, such as the Surtronic 3 surface roughness instrument supplied by Rank Taylor Hobson, P. O. Box 36, Guthlaxton Street, Leicester LE205P England. Also see U.S. Pat. No. 4,737,433, herein incorporated by reference, which describes advantages to using a receiver surface that is smooth compared to toner particle size.

In the process of this invention, the receiver is preheated to a temperature such that the temperature of the receiver during transfer will be adequate to fuse the toner particles at their points of contact but will not be high enough to melt the toner particles, or to cause contacting particles to coalesce or flow together into a single mass. That is, the particles must appear as in FIG. 2. The temperature range necessary to achieve that result depends upon the time that a receiver resides in the nip and the heat capacity of the receiver. In most cases the result shown in FIG. 2 can be achieved if the temperature of the receiver immediately after the receiver contacts the substrate is below the $T_g$ of the toner binder but above a temperature that is 20 degrees below that $T_g$. However, receiver temperatures up to 10° C. above the $T_g$ of the toner binder are tolerable when nip time is small or the heat capacity of the receiver is low. Although either side of the receiver can be heated, it is preferable to heat only the front surface of the receiver, that is, the surface of the receiver that will contact the toner particles, as this is more energy efficient, it is easier to control the temperature of that surface when the heat does not have to pass through the receiver, and it usually avoids damage to the receiver. Such heating can be accomplished by any suitable means, such as radiant heat in an oven or contacting the receiver with a heated roller or a hot shoe. The preheating of the receiver must be accomplished before the heated portion of the receiver contacts the substrate because, if the receiver is heated only in the nip, its temperature may fluctuate over a wide range and its temperature cannot easily be kept within the narrow critical range required for the successful practice of this invention. Thus, if the backup roller, which presses the receiver against the substrate, is used to heat the receiver, the receiver must be wrapped around the backup roller sufficiently so that the receiver is heated to the proper temperature before it enters the nip. The backup roller is preferably not the sole source of heat used to effect the transfer, however, because the backup roller heats the back of the receiver, which means the heat must pass through the receiver to reach the toner. As a result, depending upon the receiver used, the process speed, and the ambient temperature, at times too much heat will pass through the receiver and it will melt the toner, while at other times insufficient heat will pass through the receiver and the toner will not transfer well. Thus, while the backup roller can be heated if desired, it is preferable to use an unheated backup roller.

It has been found that pressure aids in the transfer of the toner to the receiver, and an average nip pressure of about 135 to about 1000 kPa is preferred. Lower pressures may result in less toner being transferred and higher pressures may damage the substrate and can cause slippage between the substrate and the receiver, thereby degrading the image. In any case, the toner must not be fixed during transfer but must be fixed instead at a separate location that is not in contact with the substrate. In this way, the substrate is not exposed to high temperatures and the toner is not fused to the substrate. Also, the use of the lower temperatures during transfer means that the transfer process can be much faster, 6 meters/minute or more being feasible. Either halftone or continuous tone images can be transferred with equal facility using the process of this invention. Because the electrostatic image on the substrate it not significantly disturbed during transfer it is possible to make multiple copies from a single imagewise exposure.

The process of this invention is also applicable to the formation of color copies. If a color copy is to be made, successive latent electrostatic images are formed on the substrate, each representing a different color, and each image is developed with a toner of a different color and is transferred to a receiver. Typically, but not necessarily, the images will correspond to each of the three primary colors, and black as a fourth color if desired. After each image has been transferred to the receiver, it can be fixed on the receiver, although it is preferable to fix all of the transferred images together in a single step. For example, light reflected from a color photograph to be copied can be passed through a filter before impinging on a charged photoconductor so that the latent electrostatic image on the photoconductor corresponds to the presence of yellow in the photograph. That latent image can be developed with a yellow toner and the developed image can be transferred to a receiver. Light reflected from the photograph can then be passed through another filter to form a latent electrostatic image on the photoconductor which corresponds to the presence of magenta in the photograph, and that latent image can then be developed to the same receiver. The process can be repeated for cyan (and black, if desired) and then all of the toners on the receiver can be fixed in a single step.

The following examples further illustrate this invention.

EXAMPLES 1 TO 7

Latent electrostatic images were formed by standard electrophotographic techniques on an inverted multilayer photoconductive element as described in Example 5 of U.S. Pat. No. 4,701,396, herein incorporated by reference, which had a zinc stearate rubbed surface. The images were developed with dry electrographic toners in combination with a lanthanum doped ferrite carrier. The toners used were:

(A) A toner having a particle size of 3.5 micrometers prepared by a suspension polymerization process. The toner contained 8 weight percent carbon black sold by Cabot Corp. as "Sterling R," a polystyrene binder having a $T_g$ of 62° C., sold as "Piccotoner 1221" by Hercules, and 0.2 weight percent of a quaternary ammonium charge agent sold by Onyx Chemical Co. as "Ammonyx 4002."

(B) A toner having a particle size of 7.5 micrometers. The toner contained 6 weight percent carbon black sold by Cabot Corp as "Regal 300," 1.5 weight percent phosphonium charge agent, and a polyester binder having a $T_g$ of approximately 60° C., made from 90 weight percent terephthalic acid, 10 weight percent dimethyl glutarate, and a stoichiometric amount of 1,2-propanediol.

Each of the toner imates was transferred according to the process of this invention, as is illustrated in FIG. 1, to one of three receivers. Except for Example 1, which is a control, the receivers were preheated to about 90° C. so that the receiver temperature during transfer was approximately 60° C., which heated the toner to that temperature. The following receivers were used:

(A) Polyethylene coated paper having a surface roughness average of 0.45 micrometers, sold as "Photofinishing Stock 486V" by Eastman Kodak.

(B) A clay coated graphic arts printing paper having a surface roughness average of 1.65 micrometers.

(C) An uncoated copy paper having a surface roughness average of 3.5 micrometers.

The following table gives the experiments performed and the results:

| | | | Dmax | | |
|---|---|---|---|---|---|
| Example | Toner | Receiver | Transferred | Residual | % Transferred |
| 1 | A | A | 0.33 | 0.39 | 46 |
| 2 | A | C | 0.12 | 0.40 | 23 |
| 3 | A | A | 0.86 | 0.03 | 97 |
| 4 | A | B | 0.51 | 0.15 | 77 |
| 5 | B | A | 1.53 | 0.00 | 100 |
| 6 | B | B | 1.56 | 0.00 | 100 |
| 7 | B | C | 1.06 | 0.05 | 95 |

Figure 2:
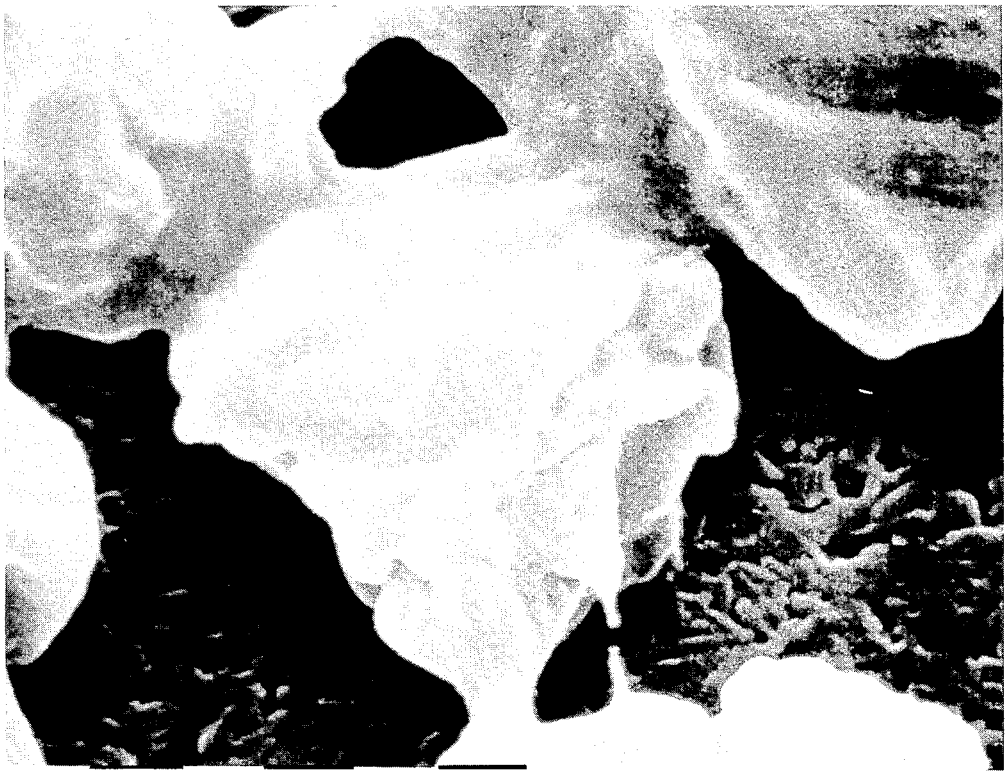
FIG. 2 is a scanning electron micrograph showing toner particles fused at their points of contact during transfer according to the process of this invention. (See Example 6.) A line representing one micrometer is shown in the lower left of FIG. 2.

In the above table, Example 1 is outside the scope of this invention because the receiver was not preheated and Example 2 is outside the scope of this invention because the roughness average of the receiver was greater than the radius of the toner particles. The table shows that Example 1 had a transfer efficiency of only 46%, and that Example 2 had a transfer efficiency of only 23%, while Examples 3 to 7, which illustrate this invention, had transfer efficiencies between 77 and 100%. FIG. 2 is a scanning electron micrograph of toner particles from Example 6 after transfer.

The invention has been described in detail with particular reference to preferred embodiments thereof, but it will be understood that variations and modifications can be effected within the spirit and scope of the invention.

We claim:

1. In method of making a hard copy wherein a latent electrostatic image on an image-bearing substrate is developed by applying to said image dry thermoplastic charged toner particles comprising a toner binder, and said developed image is transferred to the surface of a receiver by contacting said developed image on said substrate with said surface, then removing said surface from said substrate, the improvement which comprises (A) developing said latent electrostatic image with a toner having a particle size of less than 8 micrometers;

(B) heating said surface before it contacts said developed image, to a temperature such that said surface heats said toner particles when it contacts said developed image to a temperature between 10° C. above the $T_g$ of said toner binder and 20° C. below the $T_g$ of said toner binder, where said temperature is sufficient to fuse discrete toner particles that form said image to each other at points of contact between said particles, but insufficient to cause said contacting particles to flow into a single mass;

(C) non-electrostatically transferring said developed image to said surface, where said surface has a roughness average less than the radius of said toner particles; and (D) heating said developed image after it has been removed from said substrate to a temperature sufficient to fuse it to said surface.

2. A method according to claim 1 wherein during transferring said surface contacts said developed image at a pressure of about 135 to about 1000 kPa.

3. A method according to claim 2 wherein said pressure is applied by means of an unheated backup roller.

4. A method according to claim 1 wherein said substrate is photoconductive.

5. A method according to claim 4 wherein said substrate comprises an organic photoconductor.

6. A method according to claim 1 wherein said substrate is reusable.

7. A method according to claim 1 wherein said substrate is in the form of a drum.

8. A method according to claim 1 wherein said particles are smaller than 5 micrometers.

9. A method according to claim 1 wherein said toner binder has a $T_g$ between 40° and 100° C.

10. A method according to claim 9 wherein said toner binder has a $T_g$ between 45° and 65° C.

11. A method according to claim 1 wherein said toner comprises a copolymer of styrene or a derivative of styrene and an acrylate.

12. A method according to claim 1 wherein said toner comprises a polyester.

13. A method according to claim 1 wherein said receiver is coated with a thermoplastic polymer that has a $T_g$ below said temperature and less than 10° C. above the $T_g$ of said toner binder.

14. A method according to claim 13 wherein said receiver is coated with a release agent which has a lower surface energy than said substrate.

15. A method according to claim 1 wherein said receiver is paper.

16. A method according to claim 1 wherein said receiver is a sheet having two surfaces and only the surface that contacts said toner particles is directly heated.

17. A method according to claim 1 wherein more than one developed image is formed on said substrate in succession, each in a different color, and steps (A), (B), and (C) are performed after at least one developed image is formed.

18. A method according to claim 17 wherein at least three developed images are formed on said substrate, selected from the three primary colors and black.

19. A method according to claim 1 wherein said receiver is transparent.

* * * * *